US006695153B1

(12) United States Patent
Chao

(10) Patent No.: US 6,695,153 B1
(45) Date of Patent: Feb. 24, 2004

(54) RACK FOR HOLDING A PISTOL-TYPE LAWN SPRINKLER NOZZLE

(76) Inventor: Hui-Chen Chao, 75, Lau Tsuoh Lane, Liau Tso Li, Lu Kang Chen, Chang Hua Hsien (TW)

( * ) Notice: Subject to any disclaimer, the term of this patent is extended or adjusted under 35 U.S.C. 154(b) by 0 days.

(21) Appl. No.: 10/228,594

(22) Filed: Aug. 28, 2002

(51) Int. Cl.[7] ..... A47F 7/00
(52) U.S. Cl. ..... 211/70.6; 211/60.1
(58) Field of Search ..... 211/70.6, 60.1, 211/59.1

(56) References Cited

U.S. PATENT DOCUMENTS 4,418,496 A * 12/1983 Koistinen ..... 248/215
5,850,922 A * 12/1998 Fraser ..... 211/70.6
D453,884 S * 2/2002 Wang ..... D6/469
D454,013 S * 3/2002 Wang ..... D6/469
6,398,045 B1 * 6/2002 Chao ..... 211/70.6
6,508,369 B2 * 1/2003 Wang ..... 211/70.6

* cited by examiner

*Primary Examiner*—Daniel P. Stodola
*Assistant Examiner*—Erica B Harris
(74) *Attorney, Agent, or Firm*—Harrison & Egbert

(57) ABSTRACT

A rack is designed to hold a plurality of pistol-type lawn sprinkler nozzles and is formed of a top frame and a bottom frame. The top frame is provided with a plurality of through slots for holding the barrels of the pistol-type sprinkler nozzles. The bottom frame is provided with a plurality of locating slots corresponding in location to the through slots of the top frame. Each of the locating slots is provided with a seat, a locating projection extending from the seat, and a confinement portion. The bottom end of the hand grip of the sprinkler nozzles is seated on the seat such that the locating projection is inserted into a center hole of the hand grip. The confinement portion is used to confine the control lever of the sprinkler nozzles.

2 Claims, 4 Drawing Sheets

RACK FOR HOLDING A PISTOL-TYPE LAWN SPRINKLER NOZZLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a rack for holding the lawn sprinkler nozzles, and more particularly to a rack for holding the pistol-type lawn sprinkler nozzles.

BACKGROUND OF THE INVENTION

There are a variety of conventional racks, which are designed to hold a plurality of lawn sprinkler nozzles. These conventional racks are generally devoid of means to locate each of the sprinkler nozzles, so as to keep the sprinkler nozzles in an orderly manner. In addition, the conventional racks are not designed specifically for holding a specific type of lawn sprinkler nozzle.

BRIEF SUMMARY OF THE INVENTION

The primary objective of the present invention is to provide a rack which is designed specifically for holding a plurality of pistol-type lawn sprinkler nozzles.

The rack of the present invention comprises a top frame and a bottom frame. The top frame is provided with a plurality of long through slots parallel to one another. The long through slots are used to hold the barrels of a plurality of pistol-type lawn sprinkler nozzles. The bottom frame is provided with a plurality of locating slots corresponding in location to the long through slots of the top frame. Each locating slot is provided with a seat for locating the hand grip of a pistol-type sprinkler nozzle, and a confinement portion for confining the control lever of the pistol-type sprinkler nozzle.

The features and the advantages ofthe present invention will be more readily understood upon a thoughtful deliberation of the following detailed description of a preferred embodiment of the present invention with reference to the accompanying drawings.

DETAILED DESCRIPTION OF THE INVENTION

Figure 1:
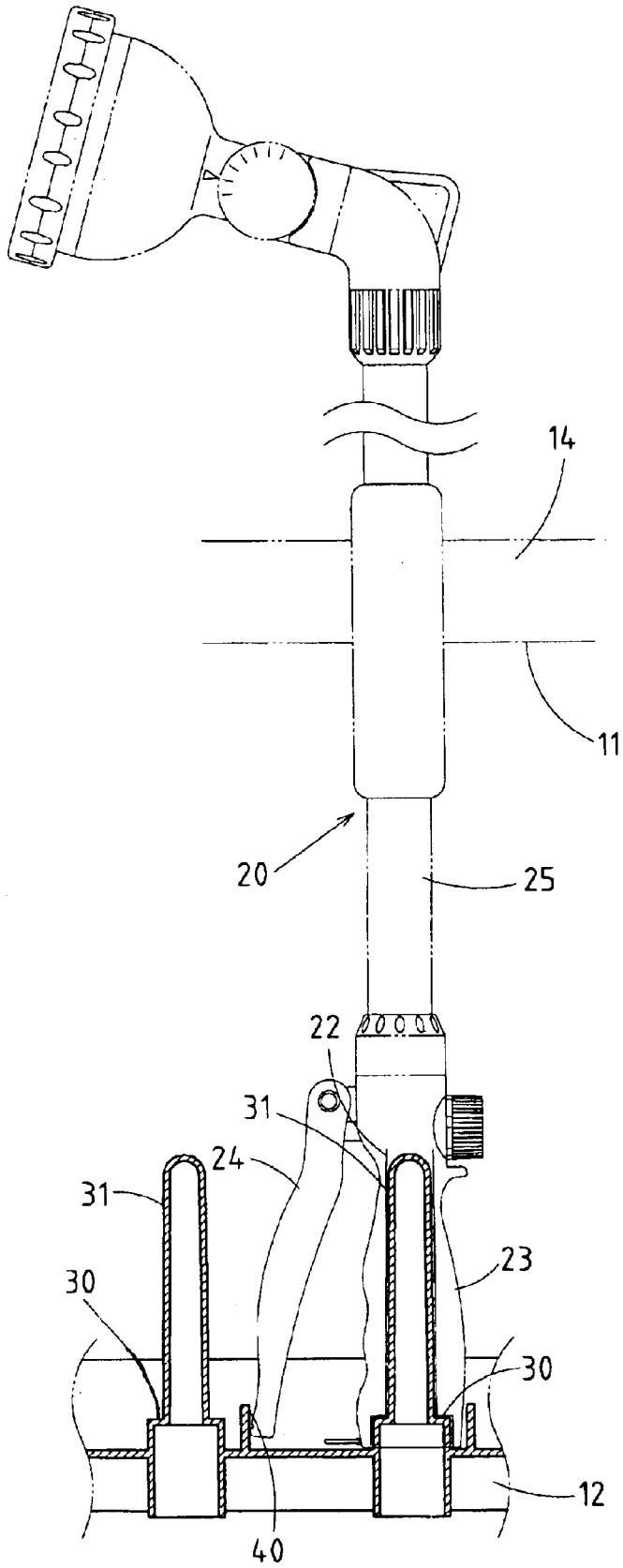
FIG. 1 shows a partial longitudinal sectional view of the preferred embodiment of the present invention.
Figure 2:
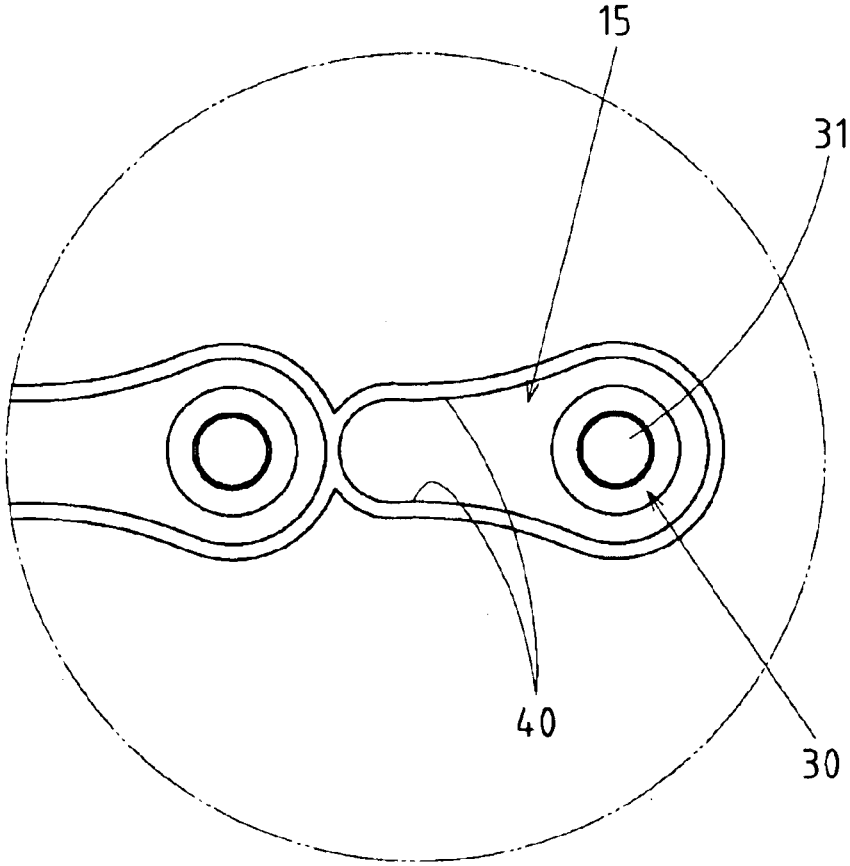
FIG. 2 shows an enlarged top plan view of the locating slot of the bottom frame of the preferred embodiment of the present invention.
Figure 3:
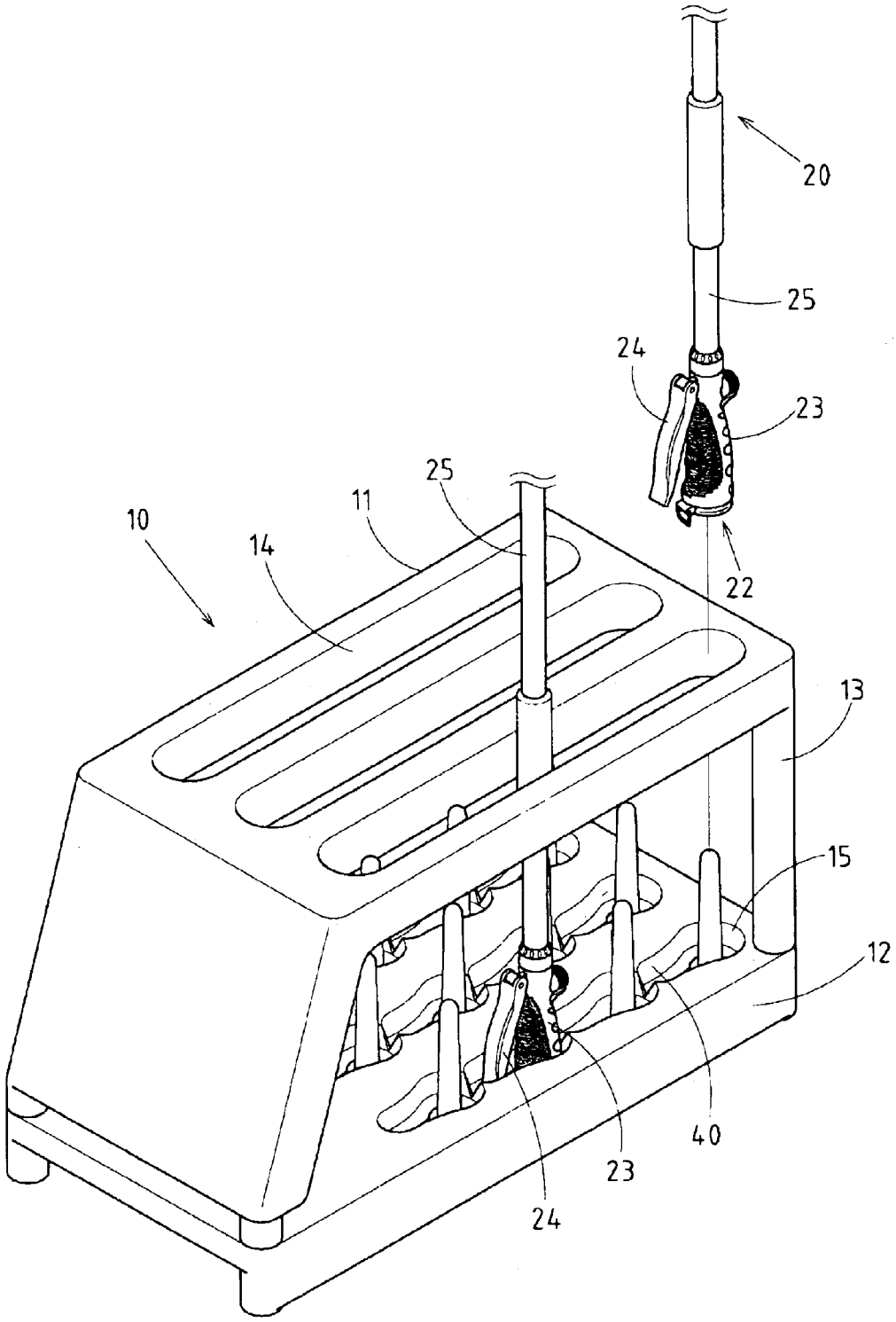
FIG. 3 shows a perspective view of the preferred embodiment of the present invention at work.

As shown in FIGS. 1–3, a rack 10 embodied in the present invention comprises a top frame 11, a bottom frame 12, and a plurality of upright support rods 13 connecting the top frame 11 and the bottom frame 12. The rack 10 of the present invention is specifically designed to hold a plurality of pistol-type sprinkler nozzles 20, each having a barrel 25, a hand grip 23, and a control lever 24. The hand grip 23 is provided at the bottom end with a center hole 22 of a predetermined depth.

The top frame 11 is provided with a plurality of long through slots 14 which are arranged at an interval and are parallel to one another. The long through slots 14 are dimensioned to accommodate the barrel 20 of the pistol-type sprinkler nozzles 20.

The bottom frame 12 is separated from the top frame 11 by a plurality of upright support rods 13 and is parallel to the top frame 11. The bottom frame 12 is provided with a plurality of locating slots 15, which are arranged in rows such that each row is corresponding in location to the long through slot 14 of the top frame. The locating slots 15 are provided with a seat 30, a locating projection 31 of a predetermined length and extending uprightly from the seat 30, and a confinement portion 40, as shown in FIGS. 1 and 2.

As illustrated in FIGS. 1 and 3, the pistol-type sprinkler nozzles 20 are held by the rack 10 of the present invention in such a manner that the barrel 25 is located by the through slot 14, and that the bottom end of the hand grip 23 is seated on the seat 30, and that the locating projection 31 is inserted into the center hole 22 of the hand grip 23, and further that the control lever 24 of the pistol-type sprinkler nozzle 20 is confined in the confinement portion 40 of the locating slot 15. A plurality of the pistol-type sprinkler nozzles 20 can be thus securely located in the rack 10 of the present invention in an orderly manner.

Figure 4:
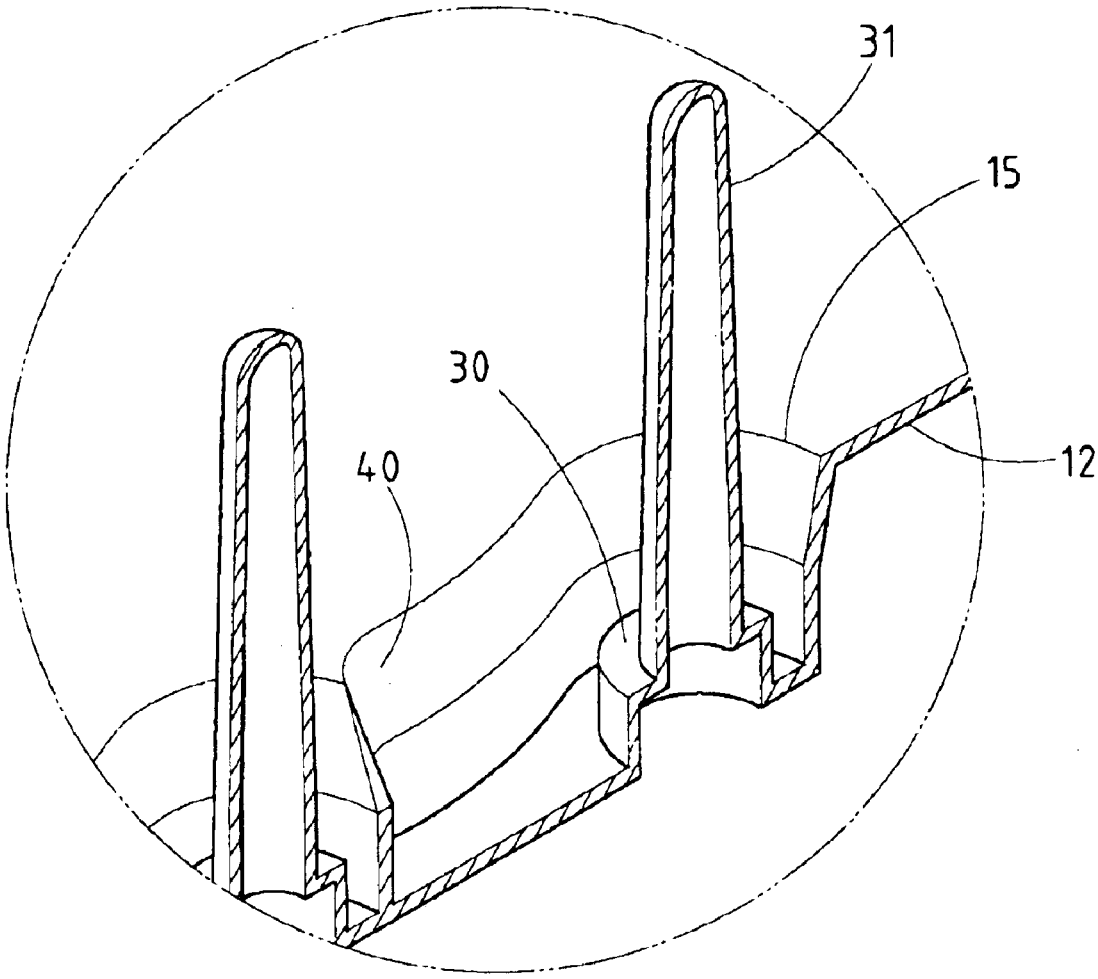
FIG. 4 shows a longitudinal sectional view of a locating projection of the locating slot of the preferred embodiment of the present invention.

As shown in FIG. 4, the locating projections 31 are of a tapered construction, with the locating projections 31 becoming smaller gradually toward the top end thereof so as to facilitate the inserting of the locating projection 31 into the center hole 22 of the hand grip 23.

The embodiment of the present invention described above is to be construed in all respects as being illustrative and nonrestrictive. Accordingly, the present invention may be embodied in other specific forms without deviating from the spirit thereof The present invention is therefore to be limited only by the scopes of the following claims.

I claim:

1. A rack apparatus comprising:

a plurality of pistol-type sprinkler nozzles each having a barrel and a control lever and a hand grip, said control lever extending angularly outwardly of said hand grip, said hand grip having a center hole of a predetermined depth at a bottom end thereof:

a top frame having a plurality of through slots of a predetermined length and a predetermined width formed therein, said plurality of through slots being in spaced parallel relationship to each other;

a bottom frame having a top surface in parallel spaced relationship to said top frame, said bottom frame being connected by a plurality of upright support rods to said top frame, said bottom frame having a plurality of locating slots formed therein, said plurality of locating slots being arranged in rows such that each row corresponds in location to a respective through slot of said plurality of through slots in said top frame, each of said locating slots receiving said control lever and said hand grip of one of said plurality of pistol-type sprinkler nozzles, said barrel of the sprinkler nozzle extending through one of said plurality of through slots of said top frame, each of said locating slots of said bottom frame having a seat positioned below said top surface of said bottom frame, said bottom frame having a slotted area formed entirely around said seat and extending outwardly therefrom in an oblong manner so as to define a confinement portion spaced away from said seat, said seat having a locating projection extending upwardly therefrom so as to extend above said top surface of said bottom frame, said center hole of said hand grip positioned over said locating projection, said bottom end of said hand grip extending over said seat, said control lever resiliently contacting said confinement portion, the confinement portion of an adjacent locating slot positioned against an outer surface of said hand grip, each of said locating slots having a a wall extending therearound, said wall being entirely vertical.

2. The rack apparatus of claim 1, said locating projection being tapered such that an end opposite said seat has a smaller diameter than a diameter of said locating projection at said seat.

* * * * *